US006180578B1

(12) United States Patent
Hemm et al.

(10) Patent No.: US 6,180,578 B1
(45) Date of Patent: Jan. 30, 2001

(54) COMPACT CLEANING AGENT FOR INDUSTRIAL DISH WASHING MACHINES

(75) Inventors: Dieter Hemm; Guenter Hellmann, both of Hilden; Klaus Wilbert, Duesseldorf, all of (DE)

(73) Assignee: Henkel Kommanditgesellschaft Auf Aktien, Duesseldorf (DE)

( * ) Notice: Under 35 U.S.C. 154(b), the term of this patent shall be extended for 0 days.

(21) Appl. No.: 09/180,078

(22) PCT Filed: Apr. 21, 1997

(86) PCT No.: PCT/EP97/01990

§ 371 Date: Nov. 5, 1998

§ 102(e) Date: Nov. 5, 1998

(87) PCT Pub. No.: WO97/41203

PCT Pub. Date: Nov. 6, 1997

(30) Foreign Application Priority Data

Apr. 30, 1996 (DE) ..... 196 17 215

(51) Int. Cl.[7] ..... C11D 7/06; C11D 11/00; C11D 17/00

(52) U.S. Cl. ..... 510/225; 510/220; 510/224; 510/475; 134/25.2; 134/42

(58) Field of Search ..... 510/220, 224, 510/225, 475; 134/25.2, 42

(56) References Cited

U.S. PATENT DOCUMENTS

| | | | | |
|---|---|---|---|---|
| 3,607,764 | | 9/1971 | Crotty et al. | 252/139 |
| 4,569,780 | * | 2/1986 | Fernholz et al. | 252/90 |
| 4,753,755 | | 6/1988 | Gansser | 252/527 |
| 4,801,396 | | 1/1989 | Altenschoepfer et al. | 252/99 |
| 5,759,976 | * | 6/1998 | Roach et al. | 510/218 |
| 5,958,862 | * | 9/1999 | Hemm et al. | 510/404 |

FOREIGN PATENT DOCUMENTS

| | | | |
|---|---|---|---|
| 31 38 425 | | 4/1983 | (DE) . |
| 42 28 786 | | 3/1994 | (DE) . |
| WO 95/18213 | * | 7/1995 | (EP) . |
| 59-182870 | | 10/1984 | (JP) . |
| 61-296098 | | 12/1986 | (JP) . |
| 62-034998 | | 2/1987 | (JP) . |
| 4-342800 | | 11/1992 | (JP) . |
| WO95/07976 | | 3/1995 | (WO) . |
| WO95/18213 | | 7/1995 | (WO) . |

* cited by examiner

*Primary Examiner*—Mark Kopec
*Assistant Examiner*—Brian P. Mruk
(74) *Attorney, Agent, or Firm*—Wayne C. Jaeschke; Real J. Grandmaison; Glenn E. J. Murphy

(57) ABSTRACT

A water-containing compact detergent composition having a controllably variable strength containing an aqueous lye solution, a viscosity increasing agent selected from a compound corresponding to formula I or formula II $$HOCH_2CH(R^1)OR^2 \quad (I)$$

$$[HOCH_2CH(R^8)_{3-x}NH_x \quad (II)$$

and a solid alkali metal hydroxide. The product is useful in domestic or institutional dishwashing machines.

17 Claims, No Drawings

COMPACT CLEANING AGENT FOR INDUSTRIAL DISH WASHING MACHINES

BACKGROUND OF THE INVENTION

1. Field of the Invention

This invention relates to water-containing cleaning formulations of controllably variable strength based on alkali hydroxide. To establish the solid consistency required, the cleaning formulations according to the invention contain glycols, glycol derivatives and/or certain alkanolamines and alkali hydroxide in solid form.

Highly alkaline cleaning formulations are now commercially available in various forms, for example as powders, granules, liquids, fused blocks or tablets produced by compression molding.

Each form has specific advantages and disadvantages for a particular application. Powders, granules or liquids have been successfully used for cleaning textile surfaces or for the manual mechanical cleaning of hard surfaces while tablets produced by compression molding or block-like cleaning compositions (fused blocks) obtained by melting and subsequent cooling are being increasingly used in addition to powders, granules or liquids for the machine cleaning of hard surfaces, for example for the machine cleaning of crockery. Tablets and fused blocks have the advantage over powders of simple and accurate dosing, do not emit any dust and are easy to handle.

These advantages can be utilized, for example, in domestic dishwashing machines and, above all, in continuous institutional dishwashing machines in which the articles to be cleaned pass through various washing zones.

It has now been found that very hard tablets and very hard fused blocks have disadvantages. For example, tablets can be damaged by breakage; tablets thus damaged obviously no longer afford the advantage of exact dosage. Another problem with tablets is that the required solubility in water cannot always guaranteed, i.e. tablets occasionally dissolve either too quickly or too slowly. Although fused blocks show high resistance to breakage during transportation, these very hard cleaning compositions present dosage problems where they are packed in relatively large containers. In addition, both tablets and fused blocks involve very complicated production processes which impose particularly stringent demands on the materials used and the conditions selected, particularly in the processing of alkaline melts.

The cleaning compositions obtained are also expected to show high homogeneity although this is often difficult to achieve in the case of compact cleaning formulations. This problem does not affect liquid cleaning formulations which can easily be stirred. Accordingly, it would be desirable to have the homogeneity of a liquid, a viscous fluid or a stirrable paste which would then harden into a solid of controllably variable strength in order at this stage to utilize its advantages for storage, transportation and dosage. It would be particularly desirable in this regard if stirrability could be maintained at temperatures of up to about 40° C. because, in that case, even components lacking heat resistance could be incorporated.

The problem addressed by the present invention was to provide highly alkaline general cleaning formulations based on alkalihydroxide, preferably potassium or sodium hydroxide and, more preferably, sodium hydroxide for textile surfaces, but preferably formulations for cleaning hard surfaces, for example crockery, and in particular institutional dishwashing detergents which would combine the advantages of powders and liquids on the one hand with the advantages of tablets and fused blocks on the other hand. In other words, the problem addressed by the present invention was to provide cleaning formulations which would show defined solubility under various conditions of use, but which on the other hand would be stable during transportation and storage and which, in addition, could be dispensed quickly, easily and accurately, would not emit any dust, could be produced without expensive machinery and could readily be packed in containers. The stirrability of the cleaning formulations during their production and their controllably variable strength during production and storage would afford major advantages and should be taken into account. To this end, the invention set out to develop a process which would enable substances lacking heat resistance to be incorporated, if necessary even at temperatures below 42° C., without compromising the other solutions to be provided.

The requirements which cleaning formulations are usually expected to satisfy, such as the development of high cleaning power, fat dissolving power, etc., would of course have to be fulfilled at the same time.

Both relatively high-viscosity to paste-like cleaning formulations and also compact cleaning formulations in tablet or block form are already known from the prior art.

2. Discussion of Related Art

The cleaning compositions disclosed in DE-OS 31 38 425, for example, assume the form of a gel-like paste which is said to exhibit such rheological behavior that it can be liquefied and readily discharged from a spray nozzle by the action of mechanical forces, for example by shaking or by the application of pressure to a deformable storage bottle or tube or by means of a metering pump.

U.S. Pat. No. 3,607,764 describes glass cleaners in compact form which are diluted to form a sprayable solution. These cleaning formulations contain inter alia sodium or potassium hydroxide, sodium or potassium tripolyphosphate, sodium or potassium pyrophosphate, hydroxycarboxylic acid builders, a water-soluble nonionic surfactant, alkylene glycol ether and, optionally, sodium carbonate. The control of viscosity or strength as achieved by the present invention is not mentioned.

JA 84/182870 describes solutions of alkali hydroxides in glycols or alcohols which become viscous through neutralization with long-chain carboxylic acids and which assume a pasty consistency through the addition of silicone oil so that they may be used as pastes in the oiling of leather.

JA 86/296098 describes water-free compact cleaning formulations based on alkali hydroxides. In this case, the alkali carrier is mixed with alkanolamines and water-soluble glycol ethers so that a compact cleaning formulation is obtained. A technical teaching for obtaining a variable reduction in strength is not disclosed.

DESCRIPTION OF THE INVENTION

The present invention relates to a water-containing compact cleaning formulation of controllably variable strength which, in the penetration test according to ISO 2137, achieves values of up to 25 mm and preferably from 0.1 to 25 mm at 20° C. and which is obtainable by a process wherein a) aqueous lye, preferably potash and soda lye and, more preferably, soda lye (preferably 42 to 55% soda lye) in a quantity of 21 to 70% by weight and preferably 35 to 55% by weight and—to build up a high viscosity— b) a compound corresponding to formula I:

$$HOCH_2CH(R^1)OR^2 \quad (I)$$

in which $R^1$ is a hydrogen atom or a methyl group and $R^2$ independently of $R^1$ is a hydrogen atom, a $C_{1-4}$ alkyl group, a group $CH_2CH—(R^3)OR^4$ or a group $CH_2CH(R^5)OCH_2CH(R^6)OR^7$, where $R^3$, $R^5$ and $R^6$ are hydrogen atoms or methyl groups and $R^4$ and $R^7$ are hydrogen atoms or $C_{1-4}$ alkyl groups, and/or compounds corresponding to formula II:

$$[HOCH_2CH(R^8)_{3-x}]NH_x \quad \text{(II)}$$

in which $R^8$ is a hydrogen atom or a methyl group and x is the number 0, 1 or 2, in a total quantity of 0.5 to 40% by weight and preferably 1 to 10% by weight (all percentages by weight being based on the cleaning formulation as a whole)

are mixed and solid alkali hydroxide is subsequently added in a quantity of up to 35% by weight.

As mentioned in the Examples, ISO 2137 describes penetration measurements with calibrated metal cylinders of which the depths of penetration are measured. The test can still be carried out when the narrowest metal cylinder used is still able to penetrate in the substance to be tested. Without seeking to limit the invention in any way, it is intended to describe some comparable consistencies which reflect the controllably variable strength.

Accordingly, cleaning formulations (detergents) according to the invention are unable to flow out from a container, for example an inverted open glass, at 20° C. to 40° C. However, the consistency according to the invention can also be reflected, for example, in the form of resistance to cutting. Many of the detergents according to the invention can still be shaped by compression molding during processing and during storage.

The present invention also relates to a process for the production of these detergents and to the use of the detergents for machine dishwashing.

The coordination of all the ingredients and features with one another in accordance with the present invention is crucial to the establishment of the required consistency.

For example, it has been found that the solid mixtures described in U.S. Pat. No. 3,607,764 cannot be converted into the compact detergent according to the invention with the desired controllable rheological properties simply by gradual dilution with water.

It has also been found that the introduction of NaOH (liquid) into alcohols or glycols does not produce a homogeneous detergent when more solid NaOH is added.

Conversely, however, no additives other than the thickener and, for example, solid alkali hydroxide, preferably potassium or sodium hydroxide and, more preferably, sodium hydroxide are needed to obtain the required solidifying effect in aqueous soda lye providing the composition of the detergent is selected in accordance with the invention. This must be regarded as surprising. In addition, it is emphasized that even the addition of the compounds corresponding to formula I or formula II together with lye, preferably potash and soda lye and, more preferably, soda lye is sufficient in itself to achieve the controllable strength required.

Finally, the water content is another critical parameter; it lies between 10 and 35% by weight and advantageously between 20 and 30% by weight.

In view of their high NaOH content, the detergents according to the invention have a pH value above 13.

In addition, the detergents according to the invention may be used in combination with other ingredients without losing their variable strength. In this sense, the detergent of lye, preferably potash and soda lye, more preferably soda lye, compound I and/or II and solid alkali hydroxide, preferably sodium hydroxide, acts as carrier phase for other ingredients typically encountered in detergents.

Accordingly, the detergents may additionally contain a builder in a quantity of up to 60% by weight and preferably in a quantity of 15 to 40% by weight as an optional ingredient.

In principle, the builder present in the detergents according to the invention may be any substance which is known in the prior art as a builder suitable in the broadest sense for detergents, water-soluble builders being preferred.

Suitable builders are, for example, alkali metal phosphates which may be present in the form of their sodium or potassium salts. Examples of such builders are tetrasodium diphosphate, pentasodium triphosphate, so-called sodium hexametaphosphate and the corresponding potassium salts or mixtures of sodium hexametaphosphate and the corresponding potassium salts of mixtures of sodium and potassium salts.

Complexing agents, for example nitrilotriacetate or ethylenediamine tetraacetate, are also mentioned as builders. Other builders which may be used in accordance with the invention are soda and borax.

Other possible water-soluble builder components are, for example, organic polymers of native or synthetic origin, above all polycarboxylates. Suitable builders of this type are, for example, polyacrylic acids and copolymers of maleic anhydride and acrylic acid and also the sodium salts of these polymer acids. Commercially available products are, for example, Sokalan® CP 5 and PA 30 of BASF, Alcosperse® 175 and 177 of Alco, LMW® 45 N and SPO2 ND of Norsohaas. Suitable native polymers include, for example, oxidized starch (for example DE 42 28 786) and polyaminoacids, such as polyglutamic acid or polyaspartic acid, for example as marketed by Cygnus, Bayer, Rohm & Haas, Rhône-Poulenc or SRCHEM.

Other possible builder components are naturally occurring hydroxycarboxylic acids such as, for example, monohydroxy and dihydroxysuccinic acid, α-hydroxypropionic acid, citric acid, gluconic acid and salts thereof. Citrates are preferably used in the form of trisodium citrate dihydrate.

Other suitable builders are amorphous metasilicates or layer silicates. Crystalline layer silicates are also suitable builders providing they are sufficiently alkali-stable. Crystalline layer silicates are marketed by Hoechst AG (Germany) under the trade name Na-SKS, for example Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$), Na-SKS4 ($Na_2Si4O_9.xH_2O$), makatite), Na-SKS-5 (p-$Na_2Si_2O_5$), Na-SKS-7 (β-$Na_2Si_2O_5$, natrosilite), Na-SKS-11 (T-$Na_2Si_2O_5$) and Na-SKS4 (δ-$Na_2Si_2O_5$).

Particularly preferred builders are those selected from the group consisting of pentasodium triphosphate, trisodium citrate, nitrilotriacetate, ethylenediamine tetraacetate and mixtures thereof.

Bleaching agents typically encountered in cleaning formulations may also be present in the detergents according to the invention. They may be selected from the group of oxygen-based bleaching agents such as, for example, sodium perborate, even in the form of its hydrates, or sodium percarbonate or from the group of chlorine-based bleaching agents, such as N-chloro-p-toluene sulfonic acid amide, trichloroisocyanuric acid, alkali metal dichloroisocyanurate, alkali metal hypochlorites and bleaching agents releasing alkali metal hypochlorites, alkali-stable bleaching compositions being particularly preferred. These may be both alkali-stable substances or components stabilized by suitable processes, for example by surface coating or passivation.

Low-foaming surfactants, above all nonionic surfactants, may also be present in a quantity of up to 10% by weight and preferably in a quantity of up to 5% by weight. Extremely low-foaming compounds are normally used. Preferred compounds of this type are $C_{12-18}$ alkyl polyethylene glycol polypropylene glycol ethers containing up to 8 moles of ethylene oxide units and up to 8 moles of propylene oxide units in the molecule. However, other nonionic surfactants known for their low-foaming behavior, for example $C_{12-18}$ alkyl polyethylene glycol polybutylene glycol ethers containing up to 8 moles of ethylene oxide units and up to 8 moles of butylene oxide units in the molecule and end-capped alkyl polyalkylene glycol mixed ethers, may also be used. It is particularly emphasized in this regard that the detergents according to the invention solve the problem stated above without the addition of these ingredients. However, they do support the cleaning performance of the detergents.

Other possible ingredients of the detergents according to the invention are defoamers. Defoamers may be used if a selected surfactant foams too vigorously under the prevailing conditions and have a foam-suppressing effect on foaming food residues in the dishwashing machine. Blending aids, such as paraffin oil, may also be present although the detergents according to the invention retain their properties without such additions.

Ingredients optionally present are other typical detergent ingredients, for example dyes or alkali-stable fragrances.

Although abrasive ingredients may be present in principle, the detergents according to the invention are preferably free from such ingredients.

Although thickeners such as, for example, swellable layer silicates of the montmorillonite type, bentonite, kaolin, talcum or carboxymethyl cellulose may optionally be used as additional ingredients to vary the strength of the compact detergents, they are not necessary for achieving the required controllable strength properties of the detergents according to the invention or their consistency, in other words there is no need for thickeners to be used.

The present invention is also concerned with the solidifying effect of the compounds corresponding to formulae I and II in combination with solid alkali hydroxide, preferably potassium or sodium hydroxide and, more preferably, sodium hydroxide or lye, preferably potash lye and soda lye and, more preferably, soda lye.

On the one hand, the invention relates to the use of compounds corresponding to formula I and/or formula II in combination with solid NaOH as a solidifying agent in water-containing machine dishwashing detergents containing alkali hydroxide, preferably sodium hydroxide.

On the other hand, the present invention relates to a process for thickening aqueous 42 to 55% by weight lye, preferably potash and soda lye and, more preferably, soda lye. The process is characterized in that a compound corresponding to formula I and/or a compound corresponding to formula II is added with stirring to such an NaOH solution to form a paste to which a solid selected from the group consisting of builders and alkali hydroxide, preferably potassium or sodium hydroxide and, more preferably, sodium hydroxide or a mixture of these substances is then added in order to achieve controllably variable strength. The process is generally carried out at 20 to 50° C., preferably at 30 to 48° C. and more preferably at 38 to 42° C.

Since the solubility of NaOH in water increases at higher temperatures, the NaOH content of the aqueous solution may even exceed 55% by weight. Correspondingly, the NaOH content may also be below 42% by weight at lower temperatures. Accordingly, the limitation to 42 to 55% by weight NaOH solutions is essentially confined to temperatures of 20° C. to 25° C.

A particular advantage of the present invention is that stirrability and the advantages which it affords exist at temperatures as low as room temperature. In some cases, for example where the thickened lye, preferably potash and soda lye and, more preferably, soda lye has a very high viscosity, it can be of advantage before adding the solid ingredients to increase the temperature slightly in order to reduce viscosity. In almost every case, however, the consistency according to the invention can be achieved at temperatures below 42° C. and preferably at temperatures of 38° C. to 42° C., so that even ingredients lacking temperature resistance, for example chlorine-containing bleaching agents, can be incorporated in the detergents according to the invention.

In one preferred embodiment, the paste is stirred for at least 3 minutes after addition of the compounds corresponding to formula I and/or II before the sodium hydroxide is introduced in solid form.

If the thickened preparation is to contain builders, they may even be present from the outset in the lye to be thickened, preferably potash and soda lye and, more preferably, soda lye. However, the builders are preferably added to the already thickened preparation—paste-like at elevated temperature—of lye, preferably potash and soda lye, more preferably soda lye, formula I and/or formula II and solid NaOH. Other ingredients optionally present are also preferably added to the already thickened preparation—paste-like at elevated temperature—of lye, preferably potash and soda lye, more preferably soda lye, formula I and/or formula II and solid NaOH.

The compact detergent according to the invention may be used, for example, by spraying the detergent of controllable strength accommodated in a container (capacity 0.5 to 10 kg for example) with water and using the detergent thus dissolved, for example introducing it into a dishwashing machine. This may be done, for example, with a dispenser of the type marketed under the name of Topmate® P40 by Henkel Hygiene GmbH or with a VVNT 2000 solids dispenser of the type marketed by Henkel Ecolab.

The detergent may be produced, for example, in a stirred tank reactor at temperatures of 20 to 50° C., preferably at temperatures of 30 to 48° C. and, more preferably, at temperatures of 38 to 42° C. The detergent may then be packed in its marketing container at around 40° C. and cooled in a cooling tunnel to around 20° C. to establish the consistency according to the invention.

However, other methods may also be used to package the detergent and to return it to room temperature.

The detergents according to the invention gradually undergo partial hardening which was determined by time-dependent measurements and which is influenced to a large extent by the particular composition of the mixtures. As a result, there are some mixtures which show no cone penetration after several days and weeks in the penetrometer test according to ISO 2137. Accordingly, the penetration values shown were measured immediately after or a few hours and days after the production of the detergents.

EXAMPLES

Detergents (1 kg) with compositions 1 to 8 shown below were produced. 50% aqueous lye was introduced into a 2 liter glass beaker. 1,2-propylene glycol was added with stirring (propeller stirrer, 100 r.p.m.) at 40° C. After the addition, the mixture was stirred for 5 minutes. Thereafter sodium hydroxide was added as the solid alkali hydroxide. Other solid substances (builders) were then added with stirring. After the addition, the mixture was stirred for 5 minutes. The penetration measurements according to ISO 2137 were carried out with a standard cone at room temperature (22° C.) approximately 5 hours, 24 hours and 48 hours after the production of the detergents. The values shown are averages of 3 measurements. Since undissolved components of various particle sizes may be present in the paste-form detergents, variations in the measured values of around ±20% are possible.

The quantities shown in the following Table relate to mixtures in grams in order to guarantee better comparability when the influence of the various ingredients and process steps is considered.

| | E1 | E2 | E3 | E4 | E5 | E6 | E7 | E8 |
|---|---|---|---|---|---|---|---|---|
| | Soda lye | | | | | Potash lye | | |
| MeOH (50% aq) | 57.5 | 53 | 53 | 53 | 53 | 39.5 | 39.5 | 39.5 |
| 1,2-Propylene glycol | 6 | 5.5 | 5.5 | 5.5 | 5.5 | 4 | — | — |
| Paraffin SIK | 1.5 | 1.5 | 1.5 | 1.5 | 1.5 | 1.5 | 1.5 | 1.5 |
| NaOH (solid) | 10 | 15 | 15 | — | 15 | 30 | 30 | 30 |
| Nitrilotriacetic acid, 92% | 25 | 25 | — | 25 | 25 | 25 | 25 | — |
| Depth of penetration (mm) 5 hours | 5.5 | 2.7 | 8.3 | 26.8 | 2.9 | 0 | 0 | 0 |
| Depth of penetration (mm) 24 hours | 4.5 | 2.0 | 7.0 | 19.7 | 2.4 | 0 | 0 | 0 |
| Depth of penetration (mm) 48 hours | 3.2 | 1.8 | 72 | 17.8 | 2.9 | 0 | 0 | 0 |

All the mixtures are homogeneously stirrable and can be packed in containers. However, their hardening rates are different.

The various ingredients have different effects on strength and its controllability. This is briefly explained in the following.

Comparison of Example E1 with Example E2 shows the influence the quantity of solid alkali hydroxide has on the variation of strength in the case of a mixture which is appropriate from the performance point of view. Any increase in the quantity of solid alkali hydroxide added leads to an increase in strength (=lower penetration value in the penetrometer test).

Comparison of Example E3 with Example E2 shows the influence of the builder optionally added. In this case, the addition of a builder leads to an increase in strength although the consistency according to the invention can also be achieved without a builder.

The influence of the solid alkali hydroxide is illustrated more clearly in Example E4 compared with Example E2. The addition of solid sodium hydroxide leads to the desired solidification.

In Example E5, nitrilotriacetic acid and solid NaOH were added in a different order compared with Example E2 in the preparation of the mixture. The properties according to the invention are still in evidence.

In Examples E6, E7 and E8, aqueous KOH was used instead of aqueous NaOH.

In these Examples, stirrability is very brief on account of the very high percentage content of solid NaOH. The hardening process proceeds so quickly that, after only 5 h, no penetration occurs in the penetration test. However, the properties according to the invention can be observed by measuring penetration at shorter time intervals after mixing.

The production of comparison detergents without the addition of a compound corresponding to formula I or formula II was carried out in the same way as described above for the detergents according to the invention, but without the addition of a compound corresponding to formula I or formula II and without the addition of solid NaOH.

| | C1 | C2 | C2 | C4 | C5 | C6 |
|---|---|---|---|---|---|---|
| Soda lye | 20 | 25 | 30 | 35 | 90 | 80 |
| Propylene glycol | — | — | — | — | 10 | 20 |
| Paraffin SIK | — | — | — | — | — | — |
| Soda calc. | 30 | 20 | 20 | 10 | — | |
| NaOH (solid) | — | — | — | — | — | |
| Water | 20 | 25 | 30 | 35 | — | — |
| Nitrilotriacetic acid, 92% | 30 | 30 | 20 | 20 | — | |
| Depth of penetration (mm), ISO 2137 | — | — | — | — | 19.5 | 4 |

C1 produces a moist lumpy powder rather than a homogeneous detergent.

C2, C3 and C4 undergo phase separation, i.e. separation of the aqueous phase, after storage for only 1 day at 25° C.

C5 and C6 in particular show the major advantage of adding solid alkali hydroxide because the consistency according to the invention can only be obtained by using large quantities of glycols and variability during solidification is at least seriously restricted.

What is claimed is:

1. The process of preparing a water-containing compact machine dishwashing detergent composition comprising:

a) mixing 21% to 70% by weight of an aqueous lye solution selected from the group consisting of potash lye and soda lye containing 42 to 55% by weight of lye with from 0.5% to 40% by weight of a viscosity increasing compound selected from compound corresponding to) one or both of formula I:

$$HOCH_2CH(R^1)OR^2 \quad (I)$$

in which $R^1$ is a hydrogen atom or a methyl group and $R^2$ independently of $R^1$ is a hydrogen atom, a $C_{1-4}$ allyl group, a group $CH_2CH(R^3)OR^4$ or a group CH2CH($R^5CH_2CH(R^6)OR^7$, where $R^3$, $R^5$ and $R^6$ are hydrogen atoms or methyl groups and $R^4$ and $R^7$ are hydrogen atoms or $C_{1-4}$ alkyl groups or formula II:

$$[HOCH_2CH(R^8)_{3-x}]NH_x \quad (II)$$

in which $R^8$ is a hydrogen atom or a methyl group and x is the number 0, 1 or 2, and b) subsequently adding to the mixture formed in a) from 0.1% to 35% by weight of a solid alkali metal hydroxide selected from the group consisting of potassium hydroxide and sodium hydroxide, said weight percents based on the weight of said detergent composition.

2. A process as in claim 1 wherein said aqueous lye solution (a) consists of sodium hydroxide, and said solid alkai metal hydroxide (b) consists of sodium hydroxide.

3. A process as in claim 1 wherein a 42 to 55% by weight NaOH solution, a compound corresponding to formula I and a compound corresponding to formula II and alkali metal hydroxide, in solid form are mixed with stirring.

4. A process for solidifying an aqueous 42 to 55% by weight sodium hydroxide solution, comprising adding to said sodium hydroxide solution from 0.5% to 40% by weight of a viscosity increasing agent selected from a compound corresponding to formula I:

$$HOCH_2CH(R^1)OR^2 \quad (I)$$

in which $R^1$ is a hydrogen atom or a methyl group and $R^2$ independently of $R^1$ is a hydrogen atom, a $C_{1-4}$ alkyl group, a group $CH_2CH(R^3)OR^4$ or a group $CH_2CH(R^5)OCH_2CH(R^6)OR^7$, where R3, $R^5$ and $R^6$ are hydrogen atoms or methyl groups and $R^4$ and $R^7$ are hydrogen atoms or $C_{1-4}$ alkyl groups or a compound corresponding to formula II:

$$[HOCH_2CH(R^8)_{3-x}]NH_x \quad (II)$$

in which $R^8$ is a hydrogen atom or a methyl group and x is the number 0, 1 or 2, or A compound of both formula I and II and subsequently adding to the solution from 0.1% to 35% by weight of a solid alkali metal hydroxide selected from the group consisting of potassium hydroxide and sodium hydroxide, said weighty percents based on the weight of the final product.

5. A process as in claim 4 including stirring the solution for at least 3 minutes after addition of the compound corresponding to formula I or formula II.

6. A process as in claim 4 wherein said solution contains a builder.

7. A process as in claim 6 wherein said builder is added to the solution after addition of the compound corresponding to formula I or formula II.

8. A process as in claim 6 wherein said builder is present in a quantity of 15 to 40% by weight, based on the weight of said solution.

9. A process as in claim 8 wherein said builder is selected from the group consisting of pentasodium triphosphate, trisodium citrate, nitrilotriacetate, ethylenediamine tetraacetate, soda, alkali metasilicate and mixtures thereof.

10. A process as in claim 4 wherein said compound corresponding to formula I is selected from the group consisting of ethylene glycol, 1,2-propylene glycol, butyl glycol and butyl diglycol and said compound corresponding to formula II is selected from the group consisting of ethanolamine, diethanolamine and triethanolamine.

11. A process as in claim 4 wherein said compound corresponding to formula I is 1,2-propylene glycol and said compound corresponding to formula II is diethanolamine.

12. A process as in claim 4 further including adding said final product to an institutional or domestic dishwashing machine.

13. A process as in claim 4 wherein the water content of said solution is from 10% to 35% by weight.

14. A process as in claim 4 further comprising combining a builder component in a quantity of up to 50 by weight, based on the weight of said detergent composition to the mixture of a) and b).

15. The process as in claim 14 wherein said builder component is selected from the group consisting of pentasodium triphosphare, trisodium citrate, nitrilotriacetate, ethylenediamine terraacetate, soda, alkali metal metasilicate, and mixtures thereof.

16. The process of claim 4 wherein said component corresponding to formula I is selected from the group consisting of ethylene glycol, 1,2-propylene glycol, butyl glycol, and butyl diglycol, and said compound corresponding to formula II is selected from the group consisting of ethanolamine, diethanolamine, and triethanolamine.

17. The process of claim 4 wherein said compound corresponding to formula I is 1,2-propylene glycol and said compound corresponding to formula II is diethanolamine.

* * * * *